US010278511B2

(12) United States Patent
Youngblood et al.

(10) Patent No.: US 10,278,511 B2
(45) Date of Patent: May 7, 2019

(54) ARTICLE COMPRISING A TEMPERATURE-CONDITIONED SURFACE, THERMOELECTRIC CONTROL UNIT, AND METHOD FOR TEMPERATURE-CONDITIONING THE SURFACE OF AN ARTICLE

(71) Applicants: Todd Youngblood, Mooresville, NC (US); Tara Youngblood, Mooresville, NC (US)

(72) Inventors: Todd Youngblood, Mooresville, NC (US); Tara Youngblood, Mooresville, NC (US)

(73) Assignee: YOUNGBLOOD IP HOLDINGS, LLC, Mooresville, NC (US)

( * ) Notice: Subject to any disclaimer, the term of this patent is extended or adjusted under 35 U.S.C. 154(b) by 741 days.

(21) Appl. No.: 14/777,050

(22) PCT Filed: Mar. 17, 2014

(86) PCT No.: PCT/US2014/030202
§ 371 (c)(1),
(2) Date: Sep. 15, 2015

(87) PCT Pub. No.: WO2014/145436
PCT Pub. Date: Sep. 18, 2014

(65) Prior Publication Data

US 2016/0029808 A1 Feb. 4, 2016

Related U.S. Application Data

(60) Provisional application No. 61/800,768, filed on Mar. 15, 2013.

(51) Int. Cl.
*A47C 21/04* (2006.01)
*F25B 21/02* (2006.01)
(Continued)

(52) U.S. Cl.
CPC ..... *A47C 21/044* (2013.01); *A47C 7/744* (2013.01); *A47C 31/105* (2013.01); *A47C 31/11* (2013.01);
(Continued)

(58) Field of Classification Search
CPC ..... A47C 21/044; A47C 7/744
See application file for complete search history.

(56) References Cited

U.S. PATENT DOCUMENTS 2,753,435 A 7/1956 Ivar
4,132,262 A 1/1979 Wibell
(Continued)

FOREIGN PATENT DOCUMENTS

WO 2014145436 A1 9/2014

OTHER PUBLICATIONS

U.S. Appl. No. 61/800,768 Youngblood, Thermo electric heating and cooling device, filed Mar. 15, 2013, Drawings and Specification.
(Continued)

*Primary Examiner* — Keith M Raymond
*Assistant Examiner* — Nael N Babaa
(74) *Attorney, Agent, or Firm* — NEO IP

(57) ABSTRACT

A thermoelectric control unit is adapted for regulating liquid temperature in a hydraulic circuit. The control unit comprises a housing, and a liquid reservoir for containing a liquid inside the housing. The reservoir has a fill opening, a liquid outlet, and a liquid return. A conduit assembly extends from the liquid outlet to the liquid return. A pump is operatively connected to the reservoir, and is adapted for moving the liquid through the conduit assembly within the hydraulic circuit. A first heat exchanger communicates with the liquid reservoir. A second heat exchanger resides adjacent the first heat exchanger, and communicates with an environment outside of the liquid reservoir and inside of the
(Continued)

housing. A substantially planar thermoelectric cooling module is located at an electrified junction between the first and second heat exchangers.

10 Claims, 4 Drawing Sheets

(51) Int. Cl.

| | |
|---|---|
| ***A47C 7/74*** | (2006.01) |
| ***A47C 31/10*** | (2006.01) |
| ***A47C 31/11*** | (2006.01) |
| ***F25B 21/04*** | (2006.01) |
| ***F25D 17/02*** | (2006.01) |
| ***F25D 29/00*** | (2006.01) |

(52) U.S. Cl.
CPC ..... *F25B 21/02* (2013.01); *F25B 21/04* (2013.01); *F25D 17/02* (2013.01); *F25D 29/00* (2013.01)

(56) References Cited

U.S. PATENT DOCUMENTS

| | | | | |
|---|---|---|---|---|
| 4,459,468 | A | 7/1984 | Bailey | |
| 4,777,802 | A | 10/1988 | Feher | |
| 4,858,609 | A | 8/1989 | Cole | |
| 5,033,136 | A | 7/1991 | Elkins | |
| 5,304,112 | A | 4/1994 | Mrklas et al. | |
| 5,329,096 | A | 7/1994 | Suematsu | |
| 5,448,788 | A * | 9/1995 | Wu | A47C 21/048 5/421 |
| 5,894,615 | A | 4/1999 | Alexander | |
| 5,948,303 | A | 9/1999 | Larson | |
| 6,163,907 | A | 12/2000 | Larson | |
| 6,273,810 | B1 * | 8/2001 | Rhodes, Jr. | A47C 4/54 454/120 |
| 6,484,062 | B1 | 11/2002 | Kim | |
| 6,581,224 | B2 | 6/2003 | Yoon | |
| 6,826,792 | B2 | 12/2004 | Lin | |
| 7,041,049 | B1 | 5/2006 | Raniere | |
| 7,238,289 | B2 | 7/2007 | Suddath | |
| 7,248,915 | B2 | 7/2007 | Rönnholm | |
| 7,306,567 | B2 | 12/2007 | Loree | |
| 7,460,899 | B2 | 12/2008 | Almen | |
| 7,524,279 | B2 | 4/2009 | Auphan | |
| 7,608,041 | B2 | 10/2009 | Sutton | |
| 7,699,785 | B2 | 4/2010 | Nemoto | |
| 7,868,757 | B2 | 1/2011 | Radivojevic et al. | |
| 8,096,960 | B2 | 1/2012 | Loree et al. | |
| 8,179,270 | B2 | 5/2012 | Rai et al. | |
| 8,191,187 | B2 | 6/2012 | Brykalski et al. | |
| 8,290,596 | B2 | 10/2012 | Wei et al. | |
| 8,348,840 | B2 | 1/2013 | Heit et al. | |
| 8,418,285 | B2 | 4/2013 | Frias | |
| 8,529,457 | B2 | 9/2013 | Devot et al. | |
| 8,617,044 | B2 | 12/2013 | Pelgrim et al. | |
| 8,768,520 | B2 | 7/2014 | Oexman et al. | |
| 9,196,479 | B1 | 11/2015 | Cheng et al. | |
| 2002/0014951 | A1 | 2/2002 | Kramer et al. | |
| 2002/0080035 | A1 | 6/2002 | Youdenko | |
| 2002/0124574 | A1 | 9/2002 | Guttman et al. | |
| 2004/0049132 | A1 | 3/2004 | Barron et al. | |
| 2005/0143617 | A1 | 6/2005 | Auphan | |
| 2006/0293602 | A1 | 12/2006 | Clark | |
| 2006/0293608 | A1 | 12/2006 | Rothman et al. | |
| 2008/0234785 | A1 | 9/2008 | Nakayama et al. | |
| 2009/0288800 | A1 | 11/2009 | Kang et al. | |
| 2010/0100004 | A1 | 4/2010 | Someren | |
| 2010/0199687 | A1 * | 8/2010 | Woods | F25B 21/02 62/3.7 |
| 2011/0015495 | A1 | 1/2011 | Dothie et al. | |
| 2011/0073292 | A1 * | 3/2011 | Datta | F28F 1/40 165/157 |
| 2011/0107514 | A1 | 5/2011 | Brykalski et al. | |
| 2011/0230790 | A1 | 9/2011 | Kozlov | |
| 2011/0267196 | A1 | 11/2011 | Hu et al. | |
| 2013/0019611 | A1 * | 1/2013 | Sims | F25B 21/02 62/3.3 |
| 2013/0060306 | A1 | 3/2013 | Colbauch | |
| 2013/0234823 | A1 | 9/2013 | Kahn et al. | |
| 2016/0029808 | A1 | 2/2016 | Youngblood et al. | |
| 2016/0151603 | A1 | 6/2016 | Shouldice et al. | |
| 2017/0053068 | A1 | 2/2017 | Pillai et al. | |

OTHER PUBLICATIONS

U.S. Appl. No. 62/398,257, Youngblood,Bed Pad With Custom Modulated Temperature Adjustment , filed Sep. 22, 2016, Drawings and Specification.

Buysse, D.J., Reynolds, C.F., Monk, T.H., Berman, S.R., & Kupfer, D.J. (1989). The Pittsburgh Sleep Quality Index (PSQI): A new instrument for psychiatric research and practice. Psychiatry Research, 28(2), 193-213.

Quan, S. F. et. al; "Healthy Sleep The Characteristics of Sleep" (Sep. 21, 2016) pp. 1-4, retrieved from http://healthysleep.med.harvard.edu/healthy/science/what/characteristics.

Tobaldini, E. et. al; "Heart rate variability in normal and pathological sleep", Frontiers in Physiology, (Oct. 16, 2013), p. 1-11, vol. 4, Article 294, doi: 10.3389/fphys.2013.00294.

Murph, Darren, "ChiliPad keeps your mattress hot, cold," engadget website, Dec. 21, 2007, www.engadget.com/2007/12/21/chilipad-keeps-your-mattress-hot-cold.†

ChiliPad Trademark Application 86282798, filed May 15, 2014, Owner Chili Technology, LLC.†

* cited by examiner
† cited by third party

ARTICLE COMPRISING A TEMPERATURE-CONDITIONED SURFACE, THERMOELECTRIC CONTROL UNIT, AND METHOD FOR TEMPERATURE-CONDITIONING THE SURFACE OF AN ARTICLE

TECHNICAL FIELD AND BACKGROUND OF THE INVENTION

This invention relates broadly and generally to an article comprising a temperature-conditioned surface, thermoelectric control unit, and method for temperature-conditioning the surface of an article.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a thermoelectric control unit adapted for regulating liquid temperature in a hydraulic circuit. The control unit comprises a housing, and a liquid reservoir for containing a liquid inside the housing. The reservoir has a fill opening, a liquid outlet, and a liquid return. A conduit assembly extends from the liquid outlet to the liquid return. A pump is operatively connected to the reservoir, and is adapted for moving the liquid through the conduit assembly within the hydraulic circuit. A first heat exchanger communicates with the liquid reservoir. A second heat exchanger resides adjacent the first heat exchanger, and communicates with a surrounding environment outside of the liquid reservoir and inside of the housing. A substantially planar thermoelectric cooling module is located at an electrified junction between the first and second heat exchangers. The cooling module has a first major surface facing the first heat exchanger, and a second major surface facing the second heat exchanger. The first major surface of the cooling module functions to cool the first heat exchanger through conduction, thereby cooling the liquid contained in the liquid reservoir. The second major surface of the cooling module generates heat which is transferred through conduction by the second heat exchanger to the environment outside of the reservoir.

According to another exemplary embodiment, the first heat exchanger comprises a metal heat sink having a planar base, and a plurality of spaced-apart planar fins extending perpendicularly outward from the base.

According to another exemplary embodiment, the planar base of the heat sink resides in direct thermal contact with the first major surface of the thermoelectric cooling module.

According to another exemplary embodiment, the fins of the heat sink extend inside the liquid reservoir, and are arranged to reside in direct thermal contact with the liquid contained in the reservoir.

According to another exemplary embodiment, the thermoelectric cooling module comprises a Peltier chip.

According to another exemplary embodiment, the second heat exchanger comprises a metal heat sink having a planar base, and a plurality of spaced-apart planar fins extending perpendicularly outward from the base.

According to another exemplary embodiment, the planar base of the second heat sink resides in direct thermal contact with the second major surface of the thermoelectric cooling module.

According to another exemplary embodiment, the fins of the second heat sink extend away from the liquid reservoir, and are arranged to reside in direct thermal contact with the environment outside of the liquid reservoir and inside of the housing.

According to another exemplary embodiment, an electric case fan is mounted inside the housing, and is adapted for moving air across the second heat sink.

According to another exemplary embodiment, a linear heat tube is located outside of the reservoir and inside the housing, and communicates with the conduit assembly to selectively heat liquid moving within the hydraulic circuit.

According to another exemplary embodiment, the conduit assembly comprises flexible (e.g., silicon) tubing extending outside of the housing to a remote temperature-conditioned article; the flexible tubing moving the liquid through the temperature-conditioned article and forming a portion of the hydraulic circuit. The term "remote" means that the article physically distant from the control unit, although interconnected by flexible tubing or the like.

In another exemplary embodiment, the present disclosure comprises the combination of a temperature-conditioned article (e.g., flexible cover) and a thermoelectric control unit. The exemplary control unit, as described herein, is adapted for adjusting liquid temperature within a hydraulic circuit running through the article.

The term "flexible cover" is defined broadly herein to mean any pad, cover, cushion, pillow, blanket, wrap, or the like. According to one exemplary embodiment, the flexible cover comprises a fabric mattress pad.

In yet another exemplary embodiment, the present disclosure comprises a method for temperature-conditioning a flexible cover. The method includes simultaneously cooling a liquid contained in a reservoir of a thermoelectric temperature control unit, and transferring heat to an environment outside of the reservoir and inside of the control unit. The cooled liquid is pumped from the reservoir within a hydraulic circuit passing from the control unit through flexible tubing inside the cover and back to the control unit.

BRIEF DESCRIPTION OF THE DRAWINGS

Exemplary embodiments of the present invention will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
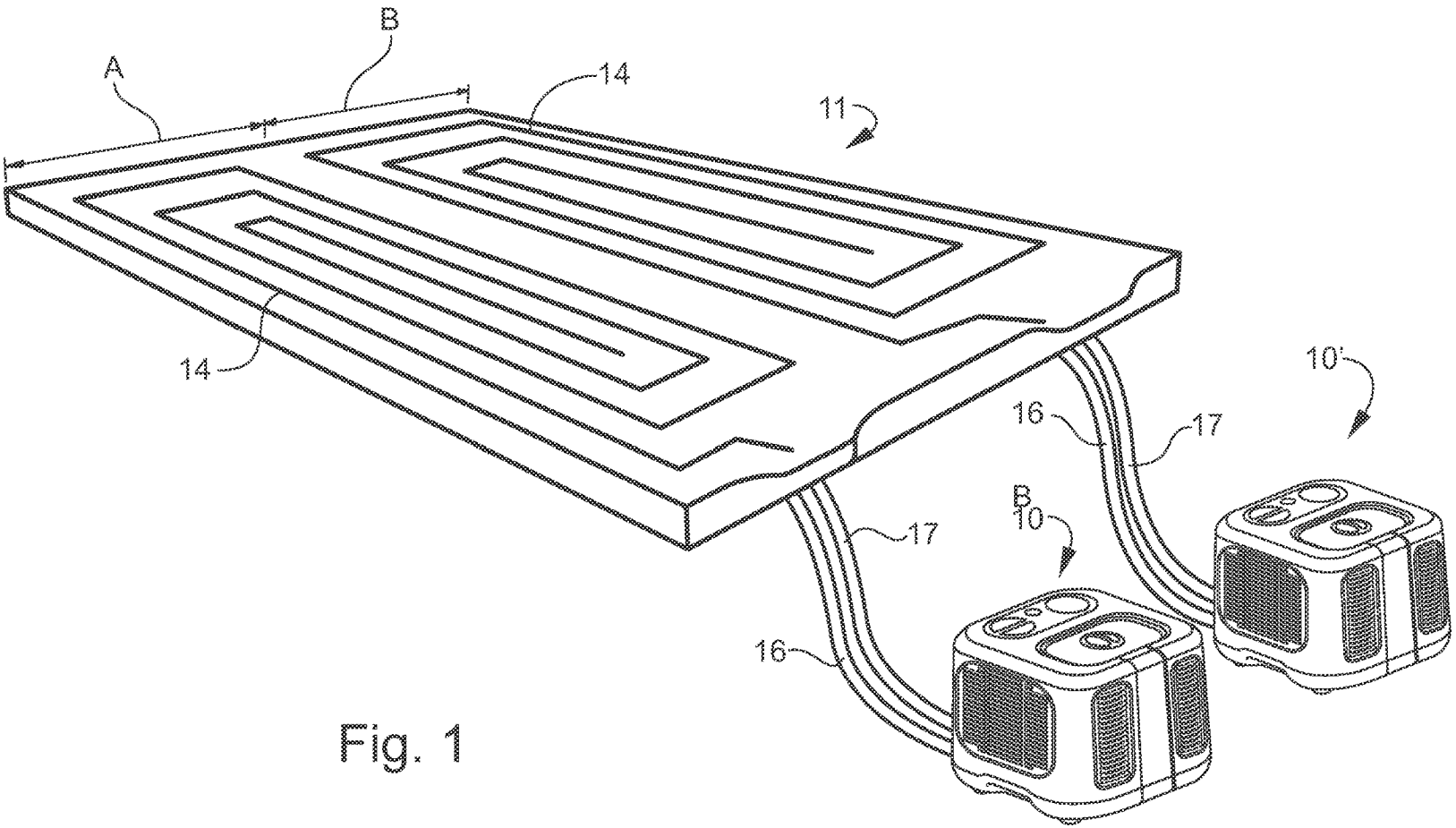
FIG. 1 is an environmental perspective view of a temperature-regulated mattress pad having two surface temperature zones connected to respective thermoelectric control units according to one exemplary embodiment of the present disclosure.
Figure 2:
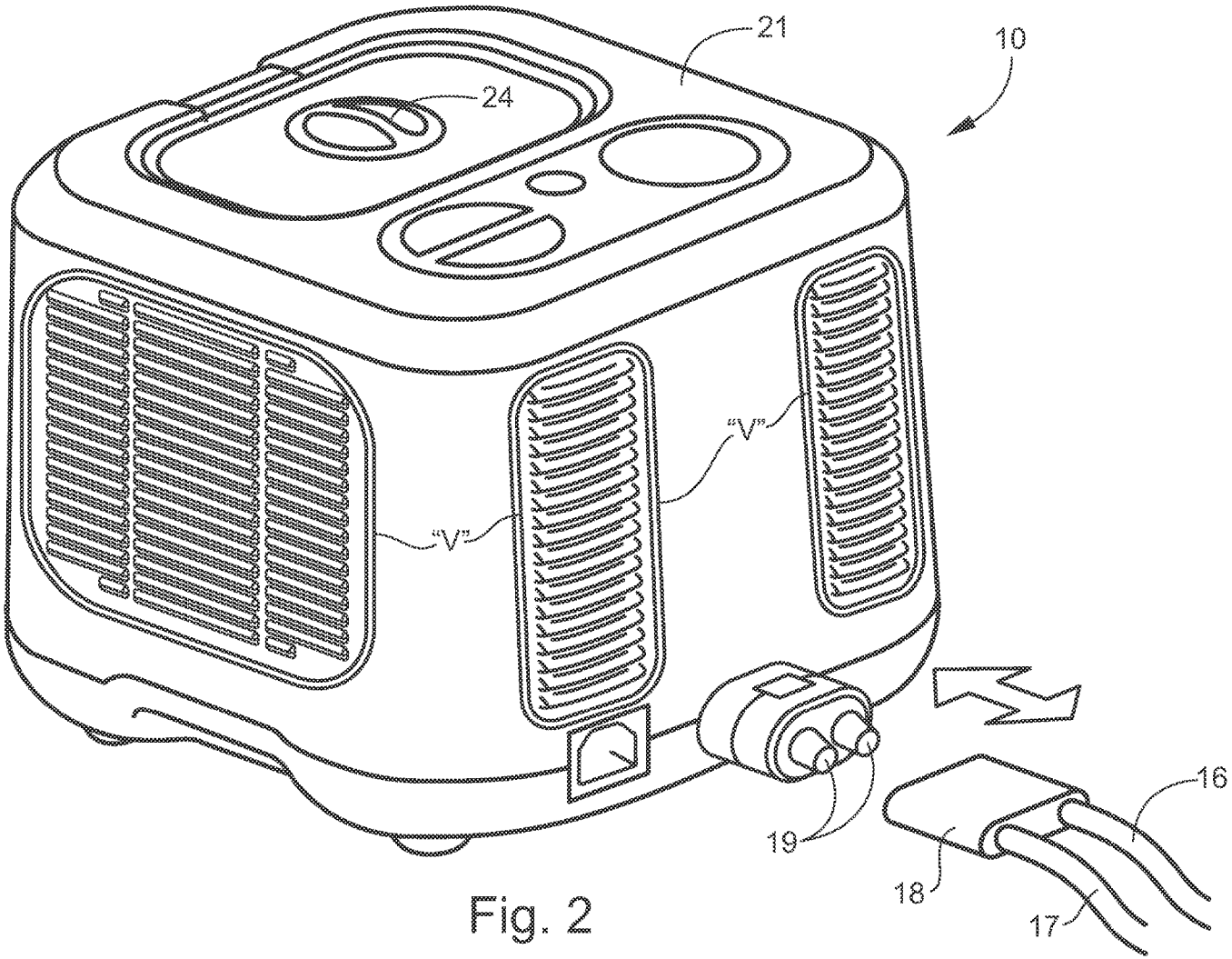
FIG. 2 is a perspective view of the exemplary control unit demonstrating the quick connection/disconnection of the flexible water supply and return lines.

Referring now specifically to the drawings, a thermoelectric control unit according to one exemplary embodiment of the present disclosure is illustrated in FIG. 1, and shown generally at broad reference numeral 10. In the exemplary implementation shown, a pair of identical control units 10, 10' attach through flexible conduit to a temperature-conditioned article, such as mattress pad 11. The mattress pad 11 has two independent thermally regulated surface zones "A" and "B"—each comprising internal flexible (e.g., silicon) tubing 14 designed for circulating heated or cooled liquid within a hydraulic circuit between the control unit 10 and mattress pad 11. As best shown in FIGS. 1 and 2, the flexible conduit assembly for each control unit 10 comprises separate liquid supply and return lines 16, 17 fluidly connected to tubing 14, and a quick-release female connector 18 for ready attachment and detachment to external male connectors 19 of the control unit 10. In alternative exemplary embodiments, the thermoelectric control unit 10 may be operatively connected (e.g., by flexible conduit) to any other temperature-regulated article, such as a blanket or other bedding or covers, seat pad, sofa, chair, mattress, or the like.

Figure 3:
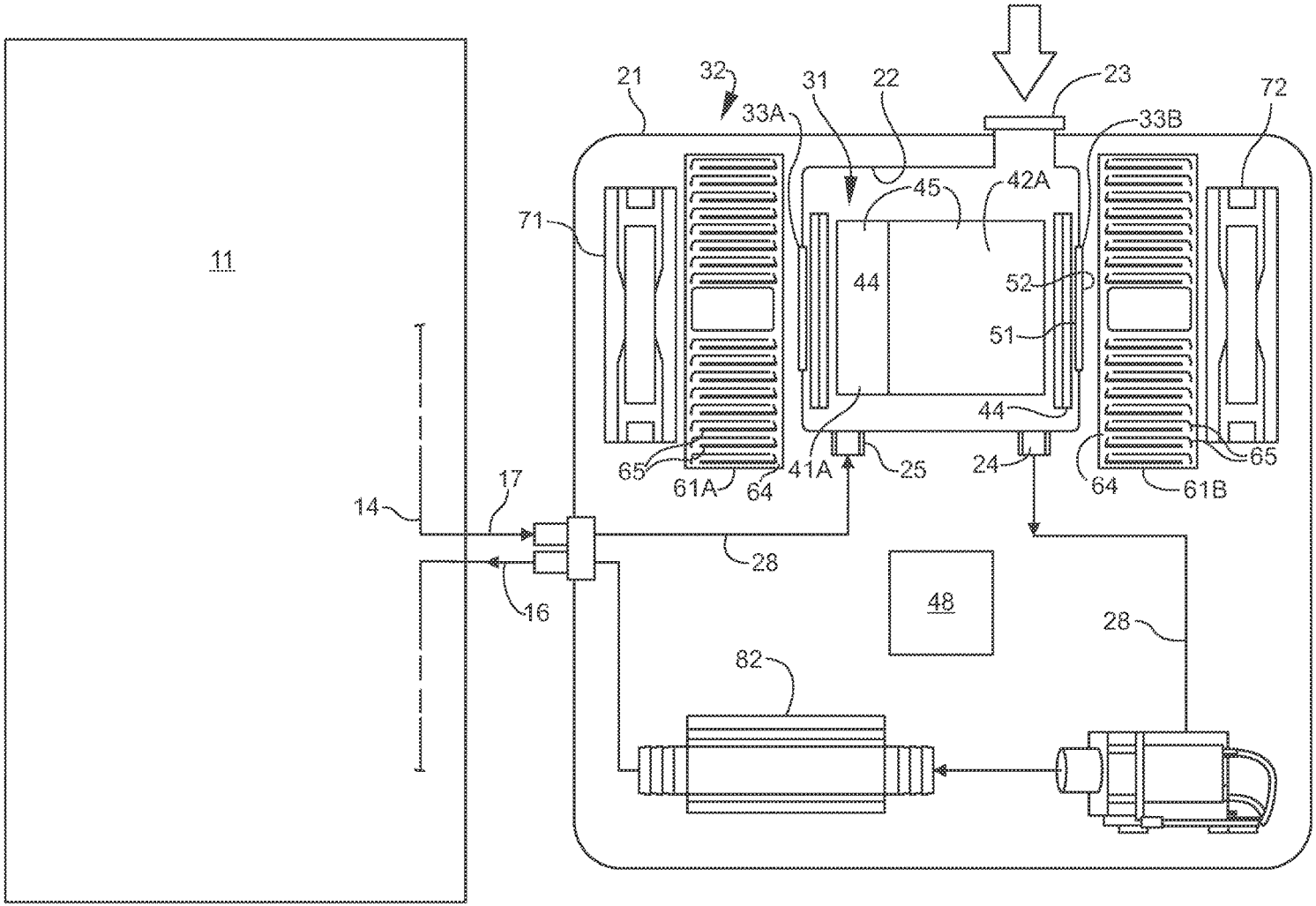
FIG. 3 is a side schematic view showing various internal components of the exemplary control unit fluidly connected to the mattress pad.
Figure 4:
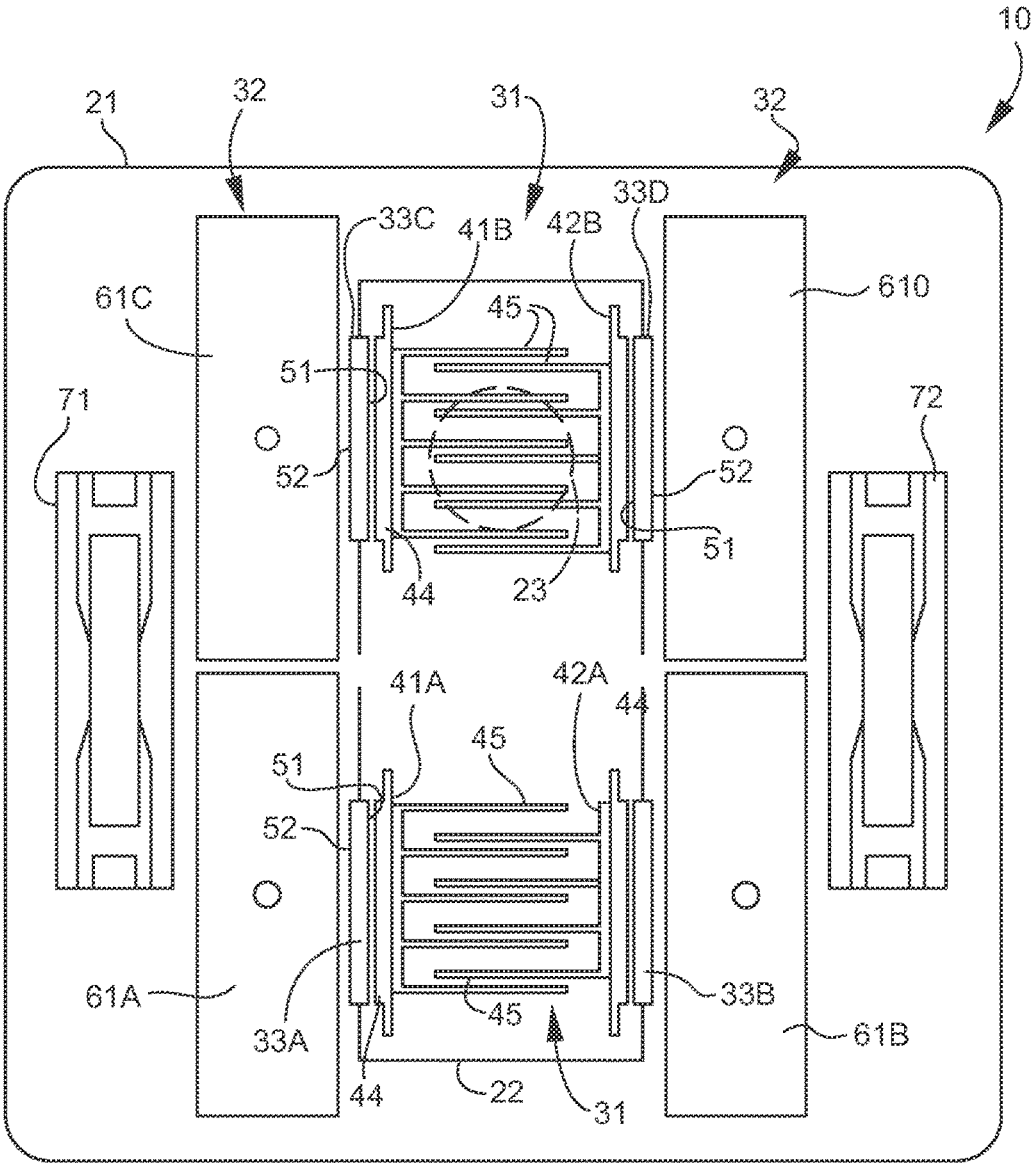
FIG. 4 is a top schematic view of the exemplary control unit.

As illustrated schematically FIGS. 3 and 4, the exemplary control unit 10 comprises an external cube-shaped housing 21, and a liquid reservoir 22 located inside the housing 21. The reservoir 22 has a fill opening 23 accessible through a removably capped opening 24 (FIG. 2) in housing 21, a water outlet 24, and a water return 25. Water contained in the reservoir 22 is moved in a circuit through a conduit assembly comprising in-housing tubes 28, the flexible supply and return lines 16, 17, and flexible silicone tubing 14 within the temperature-regulated pad 11. The water is selectively cooled, as described further below, by cooperating first and second heat exchangers 31, 32 and thermoelectric cooling modules 33A-33D. The cooling modules 33A-33D reside at an electrified junction between the first and second heat exchangers 31, 32, and function to regulate water temperature from a cool point of as low 46 degrees F., or cooler. The housing 21 and reservoir 22 may be either separately or integrally constructed of any suitable material, such as an anti-flammable ABS, polypropylene, or other molded polymer.

Referring to FIGS. 3 and 4, the first heat exchanger 31 comprises pairs of oppositely directed internal heat sinks 41A, 42A and 41B, 42B communicating with an inside of the reservoir 22, and cooperating with thermoelectric cooling modules 33A-33D to cool the water inside the reservoir 22 to a selected (set) temperature. Each heat sink 41A, 42A, 41B, 42B has a substantially planar metal base 44 adjacent an exterior side wall of the reservoir 22, and a plurality of planar metal fins 45 extending substantially perpendicular to the base 44 and vertically inward towards a center region of the reservoir 22. In the exemplary embodiment, each pair of heat sinks 41A, 42A and 41B, 42B comprises one 4-fin sink and one 5-fin sink arranged such that their respective fins 45 are facing and interleaved as shown in FIG. 4. The exemplary cooling modules 33A-33D are operatively connected to an internal power supply/main control board 48, and comprise respective thin Peltier chips having opposing planar inside and outside major surfaces 51, 52. The inside major surface 51 of each cooling module 33A-33D resides in direct thermal contact with the planar base 44 of its corresponding heat sink 41A, 42A, 41B, 42B. A thermal pad or compound (not shown) may also reside between each cooling module 33A-33D and heat sink 41A, 42A, 41B, 42B to promote thermal conduction from base 44 outwardly across the fins 45.

The second heat exchanger 32 comprises external heat sinks 61A-61D located outside of the water reservoir 22, and arranged in an opposite-facing direction to respective internal heat sinks 41A, 42A, 41B, 42B Each external heat sink 61A-61D has a planar metal base 64 in direct thermal contact with the outside major surface 52 of an associated adjacent cooling module 33A-33D, and a plurality of planar metal fins 65 extending substantially perpendicular to the base 64 and horizontally outward away from the water reservoir 22. Heat generated by the cooling modules 33A-33D is conducted by the external heat sinks 61A-61D away from the modules 33A-33D and dissipated to a surrounding environment outside of the water reservoir 22. Electric case fans 71 and 72 may be operatively connected to the power supply/main control board 48 and mounted inside the housing 21 adjacent respective heat sinks 61A, 61B and 61C, 61D. The exemplary fans 71, 72 promote air flow across the sink fins 65, and outwardly from the control unit 10 through exhaust vents "V" formed with the sides and bottom of the housing 21. In one embodiment, each external heat sink 61A-61D has a substantially larger base 64 (as compared to the 4-fin and 5-fin internal sinks 41A, 42A, 41B, 42B) and a substantially greater number of fins 65—e.g., 32 or more. Both internal and external heat sinks may be active or passive, and may be constructed of any suitable conductive material, including aluminum, copper, and other metals. The heat sinks may have a thermal conductivity of 400 watts per Kelvin per meter (W/mK), or more. The case fans 71, 72 may automatically activate and shuts off as needed.

From the reservoir 22, the temperature conditioned water exits through the outlet 24 and enters the conduit assembly comprising an arrangement of in-housing Z-, L-, 7-, and S-shaped tubes 28 (and joints). A pump 81 is operatively connected to the reservoir 22 and functions to circulate the water through the control unit 10 in a circuit including the in-housing tubes 28 (and joints), flexible water supply line 16, silicone pad tubes 14, water return line 17, and back into the reservoir 22 through water return 25. As shown in FIG. 3, an insulated linear heat tube 82 is located outside of the water reservoir 22 and inside the housing 21, and communicates with the conduit assembly to selectively heat water moving from the control unit 10 to the mattress pad 11 The exemplary heat tub 82 may heat water moving in the hydraulic circuit to a desired temperature of as warm as 118 degrees F.

The exemplary thermoelectric control unit 10 may further comprise other features and electronics not shown including a touch control and display board, overheat protectors, water level sensor, thermostat, additional case fans, and other such components. The control unit 10 may also comprise an external power cord designed to plug into standard household electrical outlets.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed:

1. A thermoelectric control unit adapted for regulating liquid temperature in a hydraulic circuit, said control unit comprising:

a housing;

a liquid reservoir for containing a liquid inside said housing, and comprising a fill opening, a liquid outlet, and a liquid return;

a conduit assembly extending from said liquid outlet to said liquid return;

a pump operatively connected to said liquid reservoir, and adapted for moving the liquid through said conduit assembly within the hydraulic circuit;

a first heat exchanger communicating with said liquid reservoir, wherein the first heat exchanger includes a first internal heat sink and a second internal heat sink, wherein the first internal heat sink includes a base and a first plurality of internal fins and the second internal heat sink includes a base and a second plurality of internal fins;

wherein the first plurality of internal fins extends perpendicularly from the first internal heat sink into the liquid reservoir such that each of the first plurality of internal fins directly contacts a liquid in the liquid reservoir and is in direct thermal contact with the liquid in the liquid reservoir;

wherein the second plurality of internal fins extends perpendicularly from the second internal heat sink into the liquid reservoir into the liquid reservoir such that each of the second plurality of internal fins directly contacts the liquid in the liquid reservoir and is in direct thermal contact with the liquid in the liquid reservoir;

a second heat exchanger communicating with an environment outside of said liquid reservoir and inside of said housing wherein the second heat exchanger includes a first external heat sink including a first plurality of external fins and a second external heat sink including a second plurality of external fins, wherein the first plurality of external fins and the second plurality of external fins extend away from the liquid reservoir and are in direct thermal contact with the environment outside of said liquid reservoir; and a first planar thermoelectric cooling module located at an electrified junction between the first internal heat sink and the first external heat sink and a second planar thermoelectric cooling module located at an electrified junction between the second internal heat sink and the second external heat sink;

wherein the first external heat sink is in direct thermal contact with an outer major surface of the first planar thermoelectric cooling module and wherein the second external heat sink is in direct thermal contact with an outer major surface of the second planar thermoelectric cooling module;

wherein the base of the first internal heat sink is in direct thermal contact with an inner major surface of the first planar thermoelectric cooling module and wherein the base of the second internal heat sink is in direct thermal contact with an inner major surface of the second planar thermoelectric cooling module; and wherein the inner major surface of said first planar thermoelectric cooling module functions to cool said first internal heat sink through conduction and wherein the inner major surface of said second planar thermoelectric cooling module functions to cool said second internal heat sink through conduction, thereby cooling the liquid contained in said liquid reservoir; and the outer major surface of said first planar thermoelectric cooling module generates heat which is transferred through conduction by said first external heat sink to the environment outside of said reservoir and the outer major surface of said second planar thermoelectric cooling module generates heat which is transferred through conduction by said second external heat sink to the environment outside of said reservoir, wherein the first plurality of internal fins is interleaved with the second plurality of internal fins.

2. The thermoelectric control unit according to claim 1, wherein the first internal heat sink is metal, wherein the second internal heat sink is metal, wherein the base of the first internal heat sink is planar, wherein the base of the second internal heat sink is planar, and wherein the first plurality of internal fins is a plurality of spaced-apart planar fins extending perpendicularly outward from the planar base of the first internal heat sink, and wherein the second plurality of internal fins is a plurality of spaced-apart planar fins extending perpendicularly outward from the planar base of the second internal heat sink.

3. The thermoelectric control unit according to claim 1, wherein the first planar thermoelectric cooling module or the second planar thermoelectric cooling module comprises a Peltier chip.

4. The thermoelectric control unit according to claim 1, wherein the first external heat sink is metal, wherein the second external heat sink is metal, wherein the base of the first external heat sink is planar, wherein the base of the second internal heat sink is planar, and wherein the first plurality of external fins is a plurality of spaced-apart planar fins extending perpendicularly outward from the planar base of the first external heat sink and wherein the second plurality of external fins is a plurality of spaced-apart planar fins extending perpendicularly outward from the planar base of the second external heat sink.

5. The thermoelectric control unit according to claim 1, and comprising a first electric case fan adapted for moving air across the first plurality of external fins and outwardly from the thermoelectric control unit and a second electric case fan adapted for moving air across the second plurality of external fins and outwardly from the thermoelectric control unit.

6. The thermoelectric control unit according to claim 1, and comprising a linear heat tube located outside of said reservoir and inside said housing, and communicating with said conduit assembly to heat liquid moving within the hydraulic circuit.

7. The thermoelectric control unit according to claim 1, wherein said conduit assembly comprises flexible silicone tubing extending from the liquid outlet downwards to the pump, flexible silicone tubing extending from the pump to a linear heat tube, flexible silicone tubing extending from the linear heat tube to an external male connector of the thermoelectric control unit, flexible silicone tubing extending from the external male connector of the thermoelectric control unit to the liquid return, flexible silicone tubing extending from a female connector of a remote temperature-conditioned article throughout the remote temperature-conditioned article and back to the female connector of the remote temperature-conditioned article, with flexible silicone tubing moving the liquid within the temperature-conditioned article and forming a portion of the hydraulic circuit.

8. The thermoelectric control unit according to claim 1, wherein the conduit assembly is silicone.

9. The thermoelectric control unit according to claim 1, wherein the liquid reservoir and the housing are constructed of anti-flammable Acrylonitrile Butadiene Styrene (ABS) or polypropylene.

10. The thermoelectric control unit according to claim 1, wherein a number of the first plurality of external fins is greater than a number than of the first plurality of internal fins and wherein a number of the second plurality of external fins is greater than a number than of the second plurality of internal fins.

* * * * *